US005964159A

United States Patent [19]

Hein

[11] Patent Number: 5,964,159

[45] Date of Patent: Oct. 12, 1999

[54] INCLINED OR VERTICAL LIFT

[76] Inventor: Wilfried Hein, Werraweg 117, D-4800 Bielefeld 11, Germany

[21] Appl. No.: 08/745,333

[22] Filed: Nov. 8, 1996

Related U.S. Application Data

[63] Continuation of application No. 08/392,627, Feb. 23, 1995, Pat. No. 5,572,930, which is a continuation of application No. 07/949,480, Oct. 14, 1992, abandoned.

[30] Foreign Application Priority Data

| | | | |
|---|---|---|---|
| Feb. 14, 1991 | [DE] | Germany | 4104512 |
| Jul. 10, 1991 | [DE] | Germany | 4122855 |
| Feb. 4, 1992 | [WO] | WIPO | PCT/EP92/00236 |

[51] Int. Cl.[6] ..... B61B 5/00

[52] U.S. Cl. ..... 104/128; 105/30; 187/250

[58] Field of Search ..... 104/89, 91, 127, 104/128, 129, 53, 55, 106, 107, 124, 126, 246; 105/30, 148, 149, 149.2, 156, 170, 165, 169, 32, 33; 187/202, 203, 245, 250, 200, 201

[56] References Cited

U.S. PATENT DOCUMENTS

| | | | |
|---|---|---|---|
| 3,518,947 | 7/1970 | Borst | 105/30 |
| 5,069,141 | 12/1991 | Ohara et al. | 105/30 |
| 5,419,260 | 5/1995 | Hamilton | 105/30 |

FOREIGN PATENT DOCUMENTS

| | | | |
|---|---|---|---|
| 394201 | 10/1990 | European Pat. Off. | 187/200 |
| 553764 | 8/1993 | European Pat. Off. | 105/30 |
| 2700322 | 7/1994 | France | 105/30 |

*Primary Examiner*—Mark Tuan Le
*Attorney, Agent, or Firm*—White & Case L.L.P.

[57] ABSTRACT

A lift for inclined or vertical operation has a pair of guide rails that run parallel to one other, on which guide rollers run that are mounted on swivel plates so that they can swivel and contact the rails from opposite sides. At least one guide roller on each swivel plate is designed as a drive roller. The periphery of the drive roller is pressed against a respective engagement area of the rail by a spring force in such a way that the drive force of the drive roller is primarily transferred to the rail by friction.

14 Claims, 11 Drawing Sheets

INCLINED OR VERTICAL LIFT

This application is a continuation of application Ser. No. 08/392,627, filed on Feb. 23, 1995, now U.S. Pat. No. 5,572,930, which is a continuation of application Ser. No. 07/949,480, filed Oct. 14, 1992, now abandoned.

BACKGROUND OF THE INVENTION

1. Field of the Invention

The invention relates to a lift of the type used for inclined lift applications, such as chair lifts, in which a frame or chassis member, supported by guide rollers, is moveable along a track having a pair of parallel, tubular guide rails. The present lift can be used either in inclined or vertical lift (i.e., elevator) applications.

2. Description of Related Art

In known inclined lifts, a pair of spaced guide rails are used to guide the rollers. The lift is driven, however, with a separate driving mechanism.

In one known apparatus, an endless cable runs inside the hollow guide rails and is connected to the moveable frame through a slot in the upper guide rail. In another apparatus, the frame is moved via toothed racks that extend parallel to the rails and on which a gear runs.

In German patent No. DE-PS 29 46 780, the frame is driven by a worm that engages a worm gear, in which the gear teeth are laid out on a plurality of plates.

All known lift devices of this general type have the disadvantage that both their production and their assembly are expensive.

European patent application No. 0 088 061 discloses a hanging conveyor, in which a chair lift hangs off a single track tube. A drive device, in frictional contact with the track, is used to move the chair lift along the track. This type of design has the critical disadvantage that it has no secure guide for the suspended load. Therefore, in most cases these designs are not permissible as lifts for people, in particular as lifts for the handicapped.

SUMMARY OF THE INVENTION

The invention is a lift which can be produced economically with simple means and still be satisfactorily functional.

A lift for inclined or vertical operation has a pair of guide rails that run parallel to one other, on which guide rollers run that are mounted on swivel plates so that they can swivel and contact the rails from opposite sides. At least one guide roller on each swivel plate is designed as a drive roller. The periphery of the drive roller is pressed against a respective engagement area of the rail by a spring force in such a way that the drive force of the drive roller is primarily transferred to the rail by friction.

The lift according to the invention has the advantage that there is a secure guiding of the frame in any desired direction and directional change. The lift according to the invention can run both on straight and on curved rails. The guide rails can be either horizontal or vertical, either ascending or descending. In addition, the guide rails can also be curved in the top view and form narrow curves, as this is sometimes necessary, for example, for use in stair wells. The design according to the invention permits any desired travel path.

It has proven particularly effective that the driving force is created by means of a guided pressure spring. Equipping it with a guided pressure spring results in the fact that even in the case where the spring breaks, the remaining spring force maintains a sufficient contact force of the drive rollers on the guide profiles.

It has proven particularly effective that the guided pressure spring extend between the two swivel plates that are fastened so that they can swivel around horizontal axles and it engages at a distance from their swivelling axles.

DESCRIPTION OF THE PREFERRED EMBODIMENTS

Figure 1:
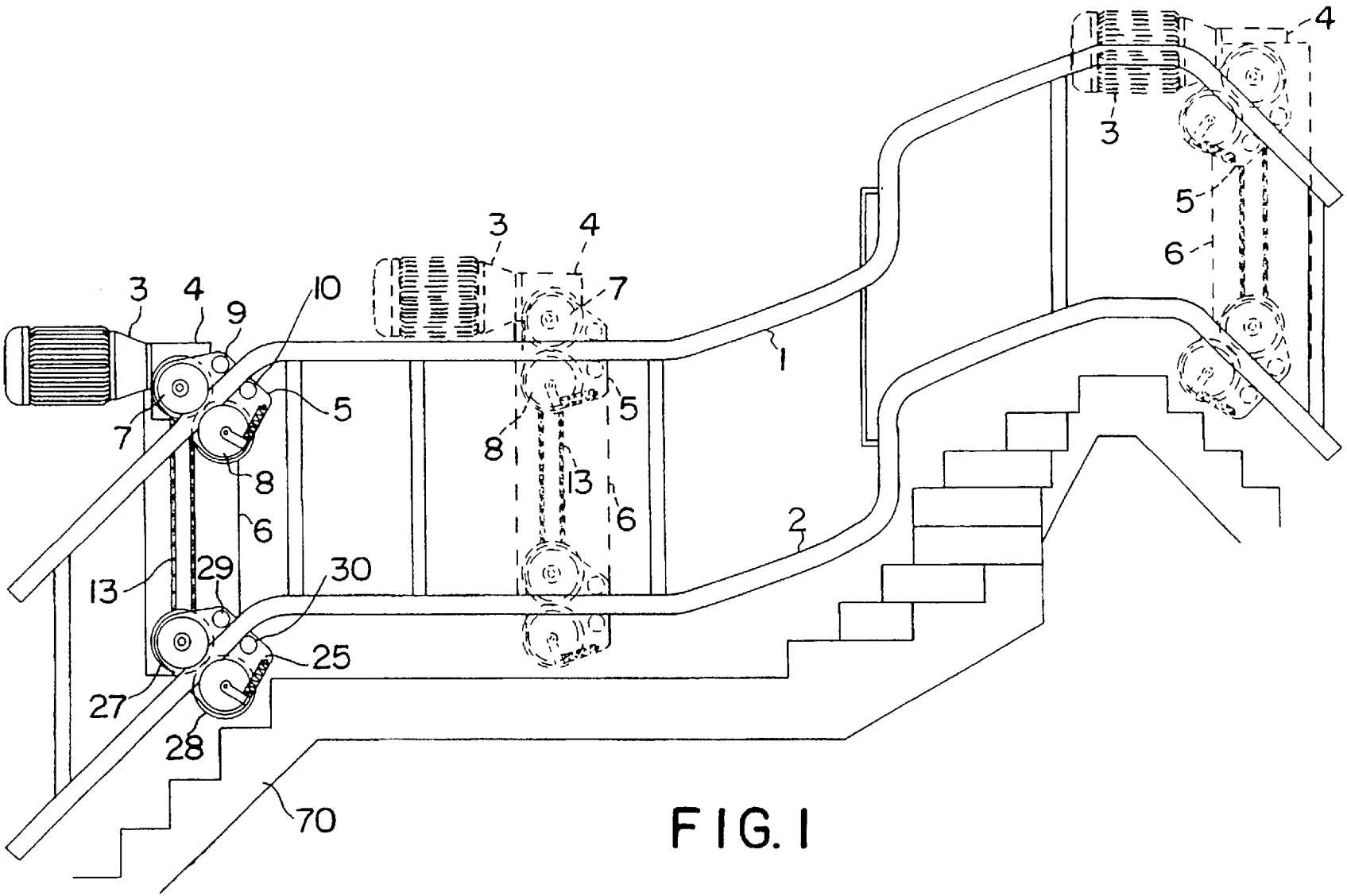
FIG. 1 is a schematic side view of a lift, shown in various positions along the track, according to a first embodiment of the invention.

In the following various embodiments, corresponding parts are designated by one or more primes of the same reference numerals.

Figure 3:
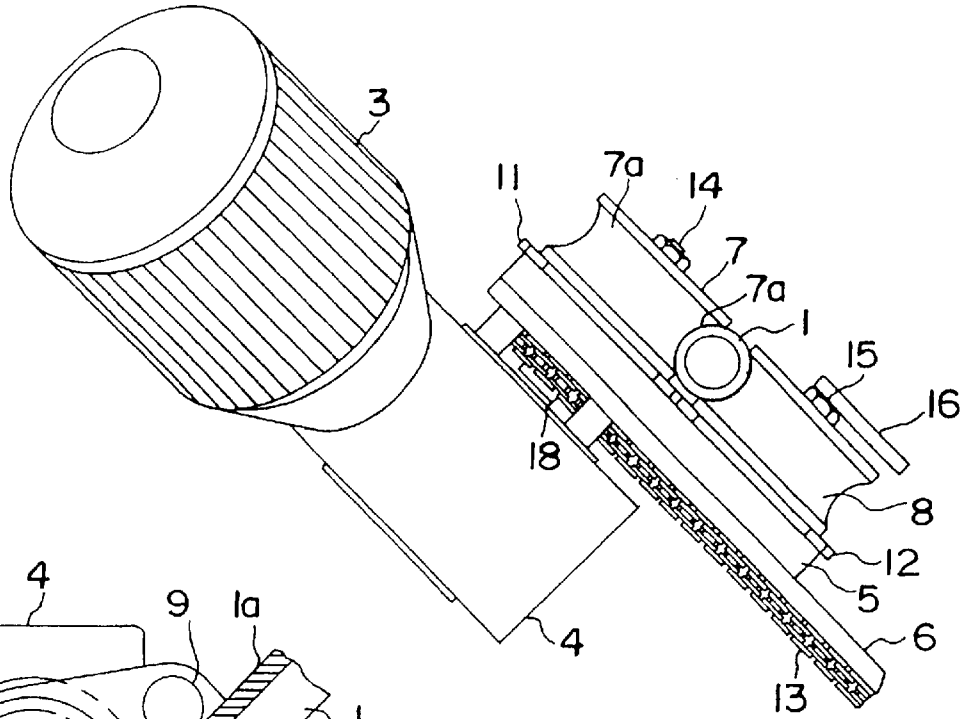
FIG. 3 is an angular view of the upper drive region, looking in the direction of arrow III of FIG. 2.
Figure 2:
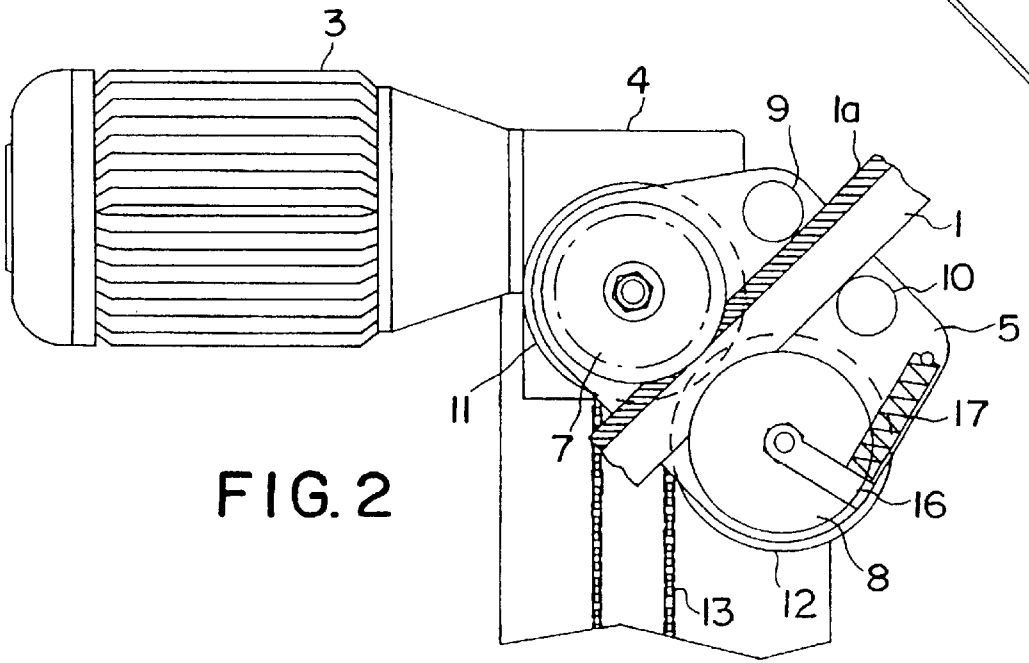
FIG. 2 is an enlarged side view of the upper drive region of the lift of FIG. 1.

Referring to FIGS. 1–3, a pair of tubular guide rails 1 and 2 are arranged along a wall above and to the side of stairs 70. The guide rails 1, 2 are parallel to one other and have a constant gauge, i.e., a constant distance from each other measured vertically.

The lift includes a frame or chassis 6, on which is provided an upper drive assembly that includes a motor 3 and a transmission 4.

The transmission drives a drive roller 7 that is mounted on a swivel plate 5 that can turn about axis 14 relative to the chassis 6, as can be seen from FIG. 1.

The drive roller 7 is coated with a plastic covering 7*a* of polyurethane to increase the friction value. The drive roller 7 is fixed relative to a gear 11 that is mounted on the same axle. The gear 11 engages a gear 12, which in turn is fixed to a second roller 8 that is rotatable about an axis 15. The drive roller 7 and the driven roller 8 clamp the guide rail 1 between the two rollers 7, 8. The guide rail 1 has an engagement area la that is roughened. The periphery of the drive roller 7, which as shown in FIG. 3 is concave to conform to the tubular shape of the guide rail 1, runs on this engagement area 1*a*. Drive roller 7 and engagement area 1*a* thus are engaged with each other through frictional contact.

A pair of guide rollers 9 and 10 are also rotatably mounted on the swivel plate 5 so as to lie on opposite sides of the guide rail 1.

The distance between rotary axis 14 and rotary axis 15 can be changed because of the fact that the position of the rotary axis 15 is defined by a bolt that is mounted eccentrically (which is not shown) relative to the swivel plate 5. A lever arm 16 is fixed at one end to the eccentric bolt. A spring element 17 engages the other end of this lever arm in such a way that the spring force urges the lever arm 16 to rotate to reduce the spacing between the axes 14 and 15 of the rollers 7, 8. In this way the contact force between the roller pair 7,8 and the guide rail 1 can be selected corresponding to the spring force.

A chain pinion 18 is mounted on the same axle as the drive roller 7 for rotation therewith. A drive chain 13 runs over the chain pinion 18 and engages a corresponding pinion on a lower drive, which includes a lower drive roller 27. The lower drive is similar in structure to the upper drive except that the drive roller 27 is driven by the lower chain pinion and drive chain 13, rather than by a motor and transmission. As in the case of the upper drive roller 7, the lower drive roller 27 is connected to drive a second roller 28 via gears, similar to gears 11 and 12. Guide rollers 29 and 30 rest on a lower swivel plate 25 that is installed so that it can swivel relative to the chassis 6.

Figure 4:
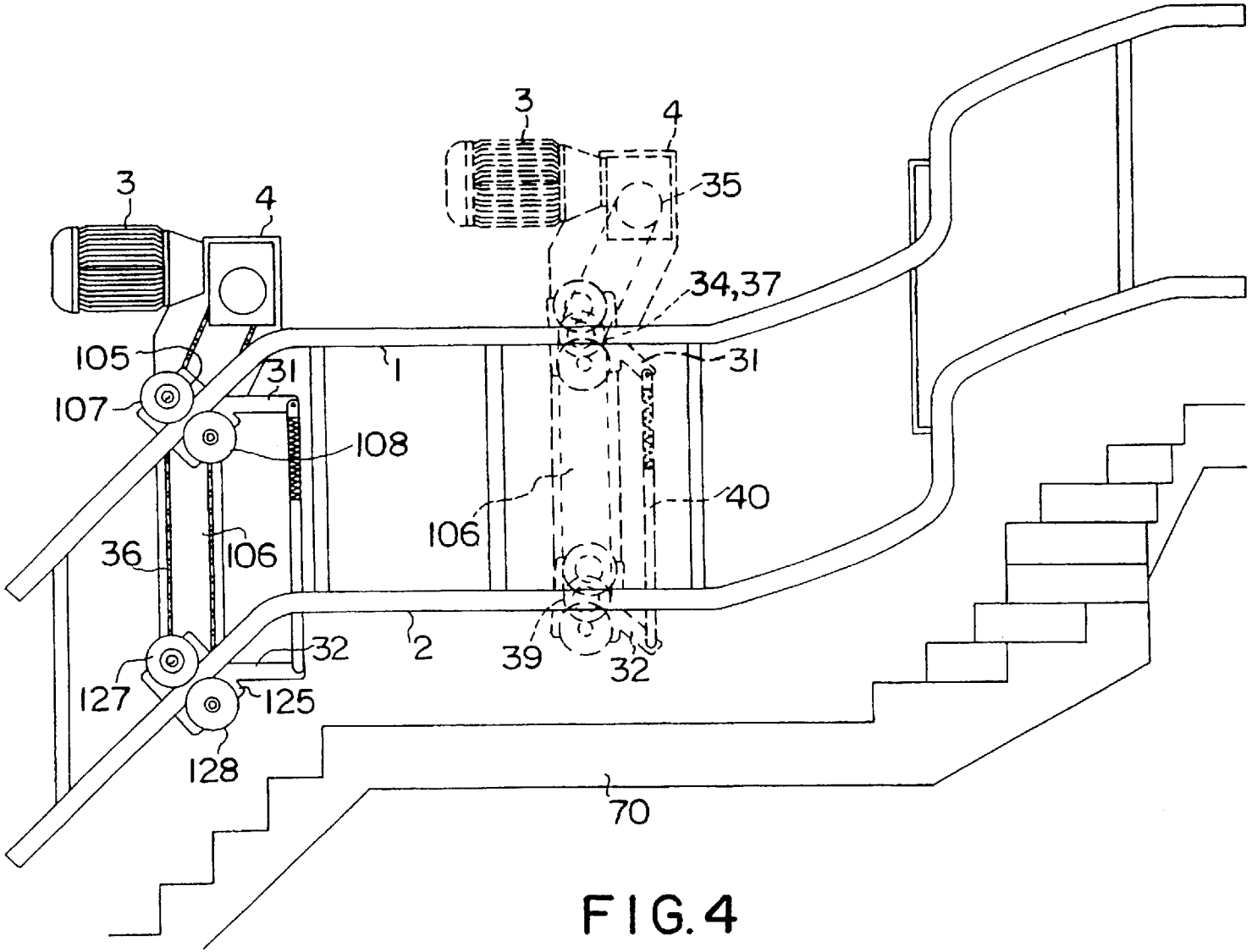
FIG. 4 is a schematic side view of a second embodiment.
Figure 5B:
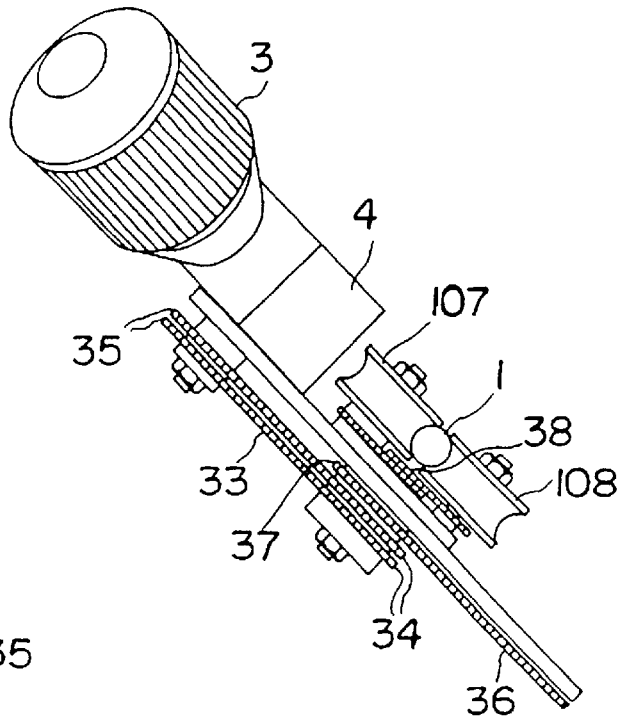
FIG. 5*b* is an angular view of the upper drive region, looking in the direction of arrow Vb of FIG. 5*a;*
Figure 5A:
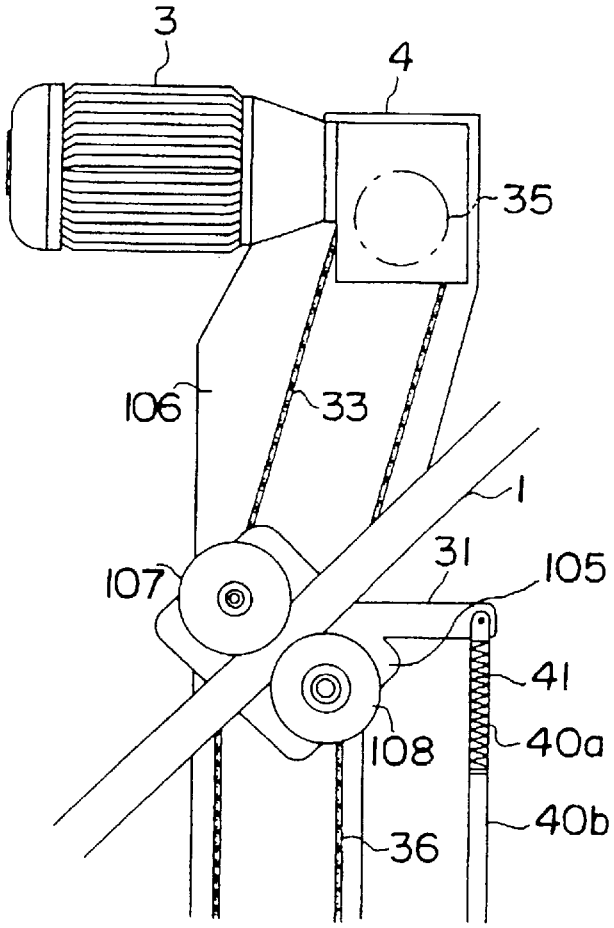
FIG. 5*a* is an enlarged side view of the upper drive region of the lift of FIG. 4.

FIGS. 4, 5*a*, and 5*b* illustrate a second embodiment, in which the upper drive roller 107 is coupled to the motor 3 and transmission 4 by way of double chain gears 34 and 35 and double chain 33. The rotary axis of the double chain gear 34 is also the swivel axis for the swivel plate 105 on chassis 106. Chain gear 34 rotates two other gears, a central gear 38 and a chain gear 37. Gear 38 in turn engages a gear on drive roller 107, and a gear on roller 108, causing the two rollers 107 and 108 to rotate in opposite directions.

A chain 36 engages the chain gear 37, and also a chain gear 39 on the lower drive assembly (see FIG. 4), which transfers its rotary motion to the lower drive rollers 127 and 128, mounted on the a swivel plate 125, in a manner similar to the upper drive assembly.

The upper swivel plate 105 has a lever arm 31. The lower swivel plate also has a lever arm 32. A lever 40 with a variable length is attached to the free ends of the lever arms 31 and 32. The lever 40 includes a tube 40*a* that closely surrounds pin 40*b*, but still allows movement. A pressure spring 41 urges the lever 40 to elongate, and in this process rotates the two swivel plates 105 and 125 in opposite directions to each other by engagement on the lever arms 32 and 31. In this process, drive roller 107 and corresponding roller 108, as well as drive roller 127 and roller 128, are pressed against the respective guide rails 1 and 2.

Figure 6:
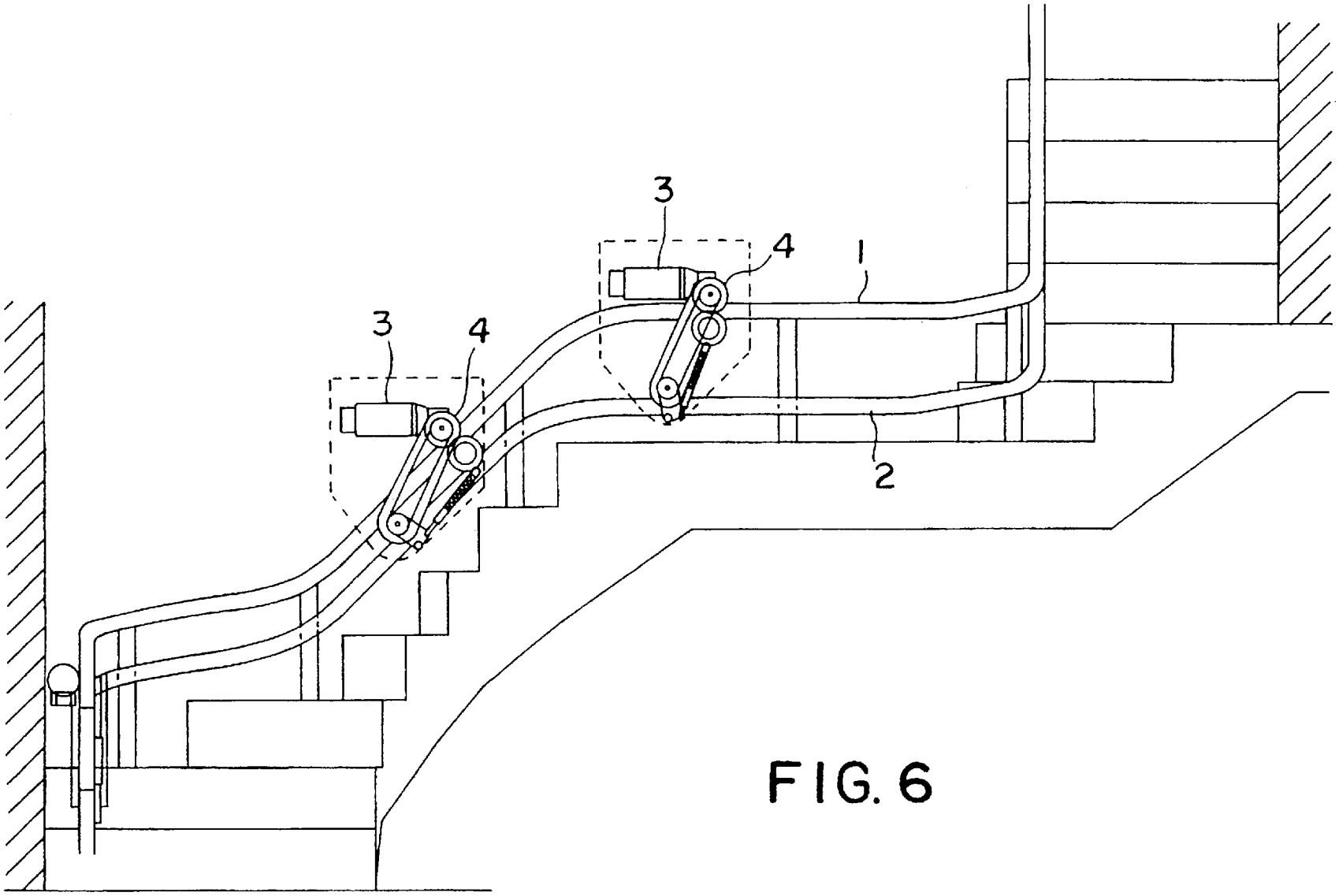
FIG. 6 is a schematic side view of a third embodiment, that is designed as a chair lift.
Figure 8:
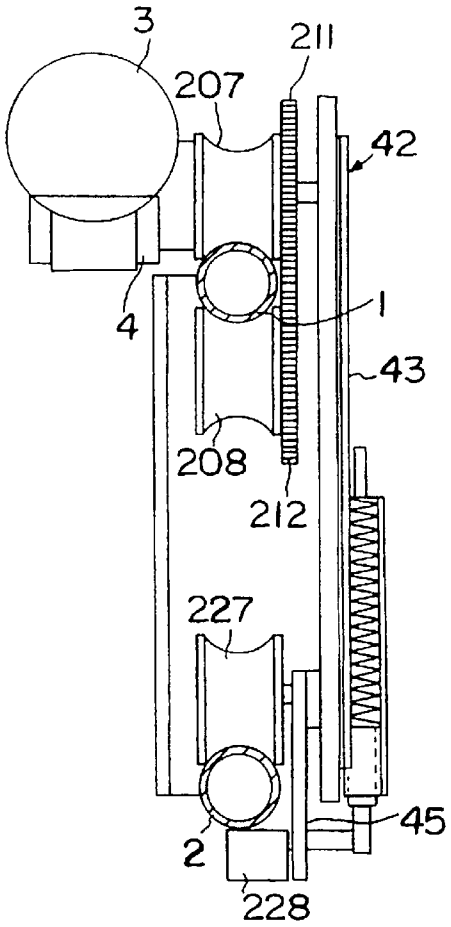
FIG. 8 is a schematic front view of the chair drive mechanism of FIG. 6, looking in the direction of arrow VIII of FIG. 7.
Figure 7:
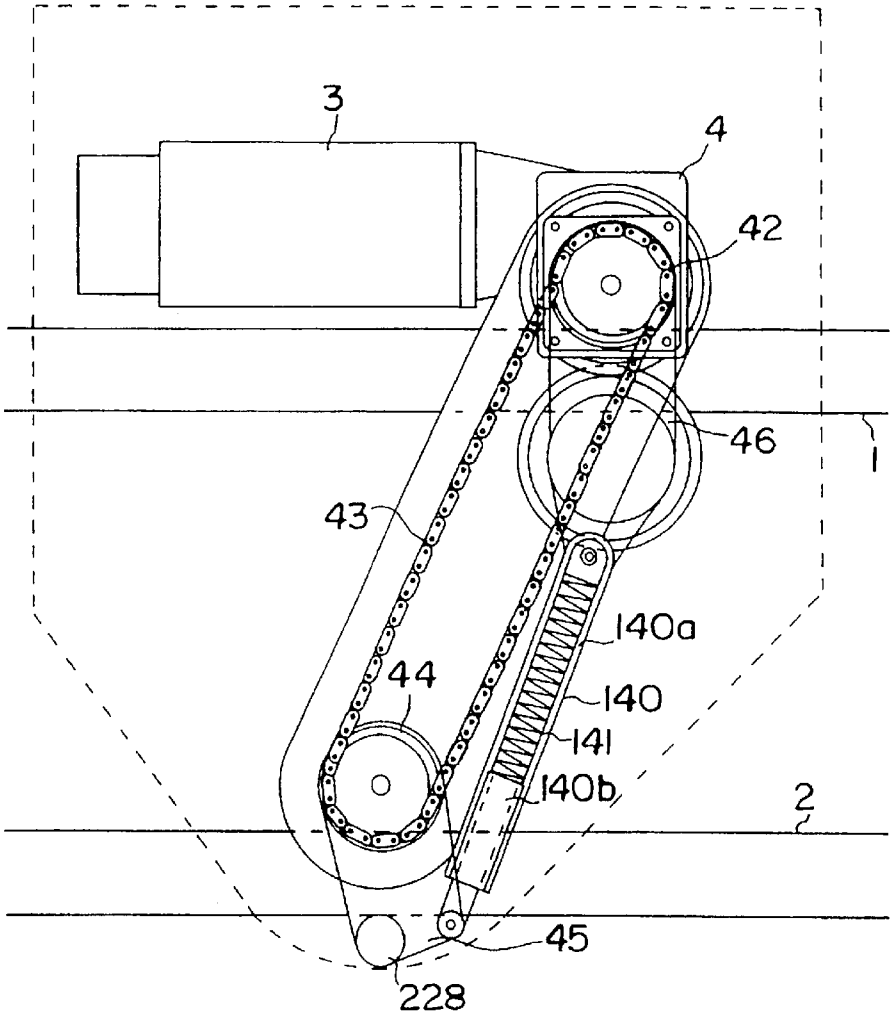
FIG. 7 is an enlarged side view of the chair drive mechanism of FIG. 6.

FIGS. 6 to 8 illustrate an example of a chair lift. A motor 3 and transmission 4 drive a drive roller 207 which is fixed to a gear 211 for rotation therewith. The gear 211 meshes with a gear 212, that is fixed to another roller 208.

Rotation of the drive roller 207 rotates a chain gear 42, which is connected to a lower chain gear 44 by a chain 43. This lower chain gear 44 is connected to the lower drive roller 227 so that it turns with it. The lower drive roller 227 is rotatably mounted on a swivel plate 45, whose swivel axis is coincident with that of the drive roller 227. The lower swivel plate 45 has a relatively small roller 228 disposed on the opposite side of guide rail 2 from drive roller 227.

The upper drive roller 207 and the associated driven roller 208 are mounted on an upper swivel plate 46. A lever 140 that can vary slightly in length extends between the upper swivel plate 46 and the lower swivel plate 45. The lever 140 includes a tube 140*a* and a piston 140*b*. A pressure spring 141 attempts to expand the lever 140 and thereby increase the distance between the linking points, and in so doing presses the drive rollers against the tubular guide rails 1 and 2.

Figure 9:
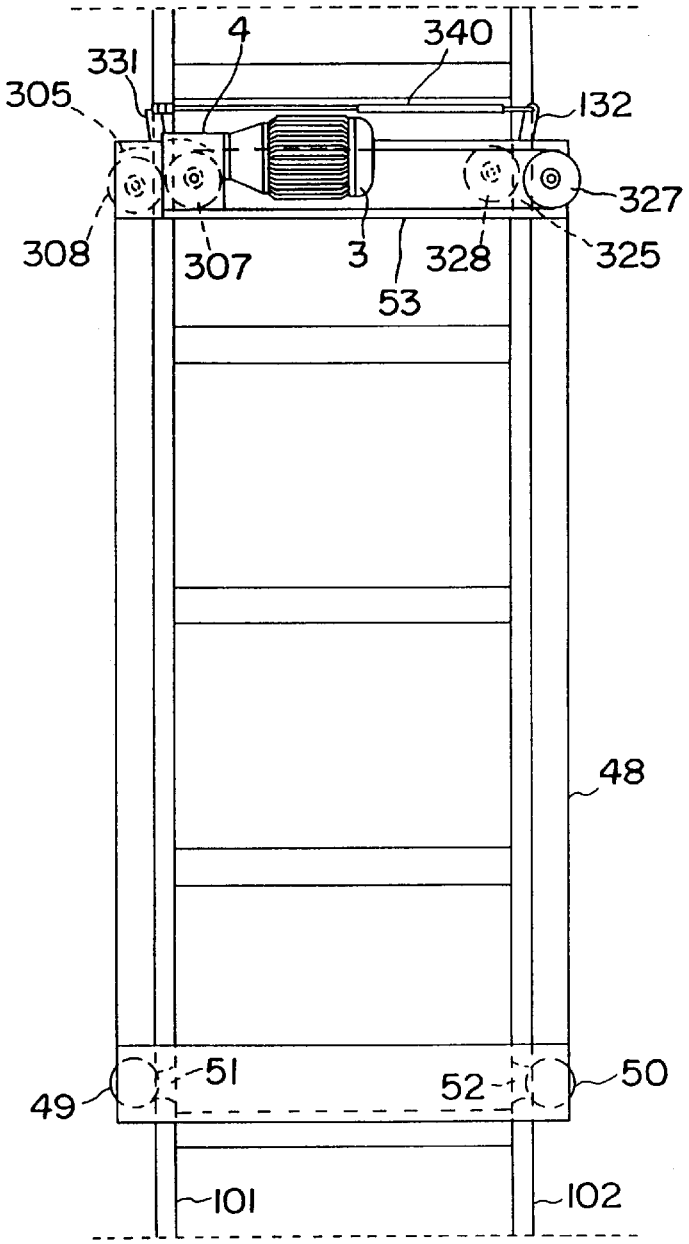
FIG. 9 is a side view of a vertical lift that is only partially shown.
Figure 10:
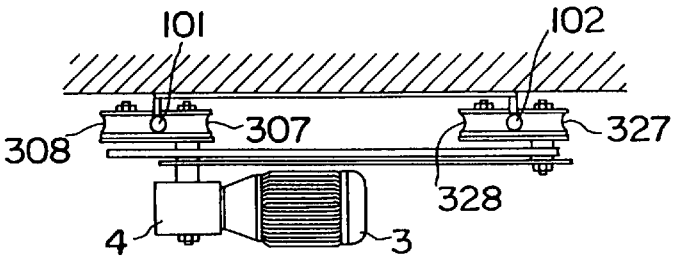
FIG. 10 is a top view of the drive unit of the vertical lift, looking in the direction of arrow X in FIG. 9.

FIGS. 9 and 10 show a vertical lift, i.e., an elevator, with a pair of rails 101 and 102 that are secured to a vertical wall. Only the frame 48 of the elevator car is shown. The lower end of the frame has two running rollers 49 and 50 that rotate in a plane parallel to the vertical wall, and two additional guide rollers 51 and 52 that are oriented at 90° to the rollers 49 and 50.

The drive assembly, which is mounted at the upper end of the frame 48, includes a motor 3 with transmission 4. The transmission 4 turns a drive roller 307 which is linked to another drive roller 327 by a chain 53. The drive roller 307 is mounted on a swivel plate with another roller 308. The swivel plate can swivel relative to the rail 1, and includes a lever arm 331. The drive roller 327 is mounted with its corresponding roller 328 on a swivel plate 325 having a lever arm 332. A lever 340 with variable length is mounted between the two free ends of the lever arms 331 and 332, and is designed in the same manner as the lever arm 40 in the embodiment according to FIGS. 4 and 5*a*.

Figure 11:
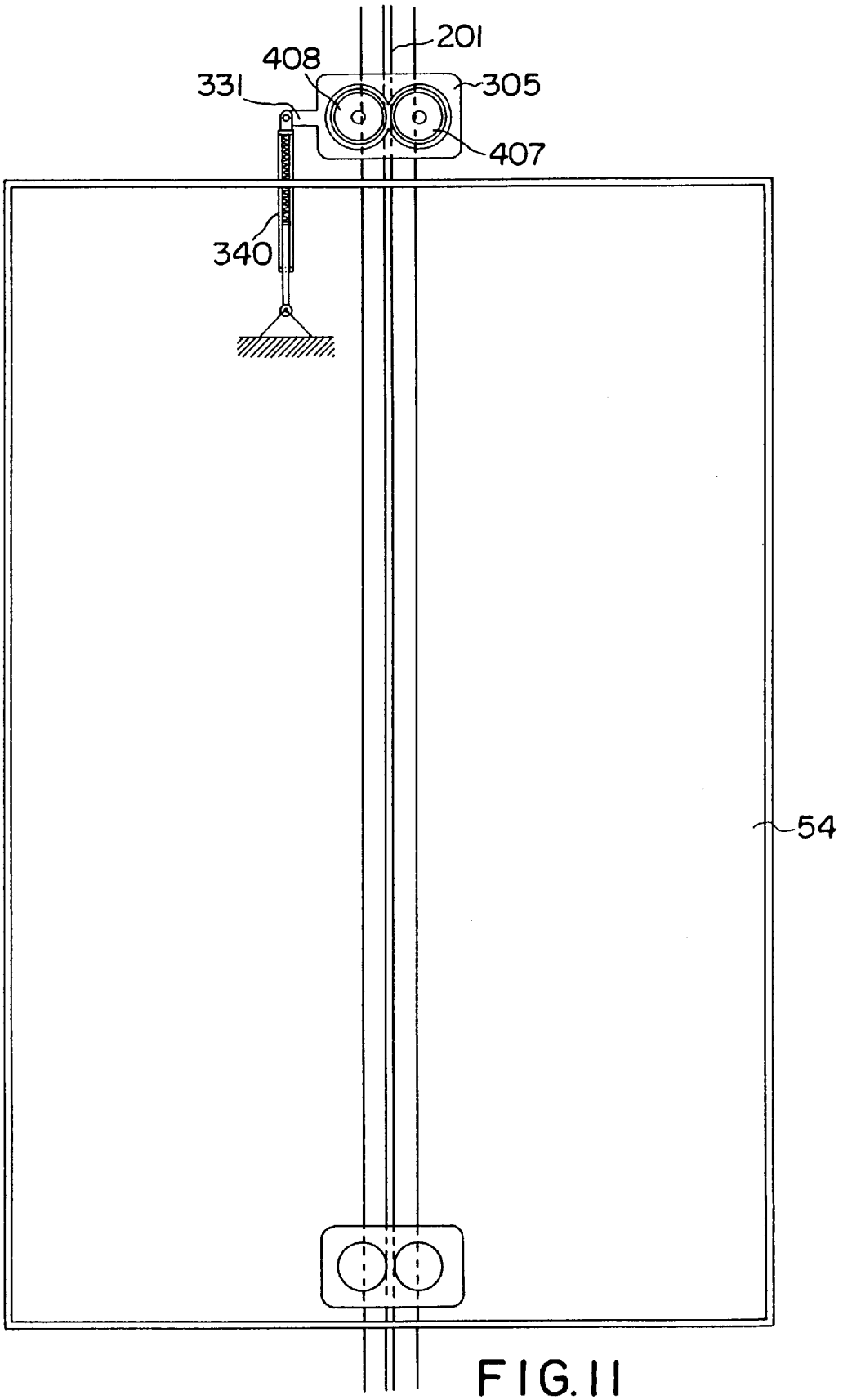
FIG. 11 is a schematic side view of another embodiment of a vertical lift.
Figure 12:
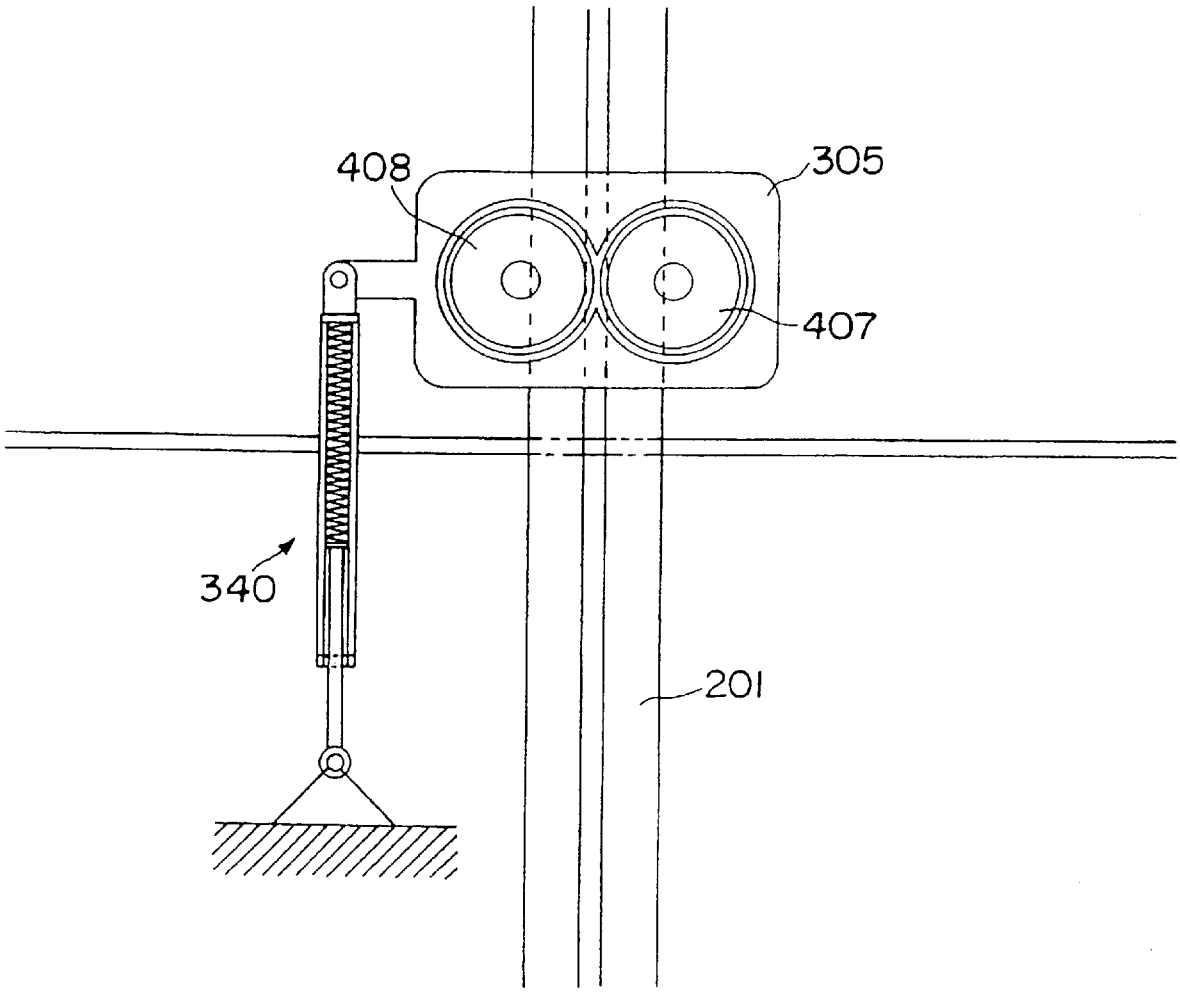
FIG. 12 is an enlarged side view of the drive mechanism of FIG. 11.
Figure 13:
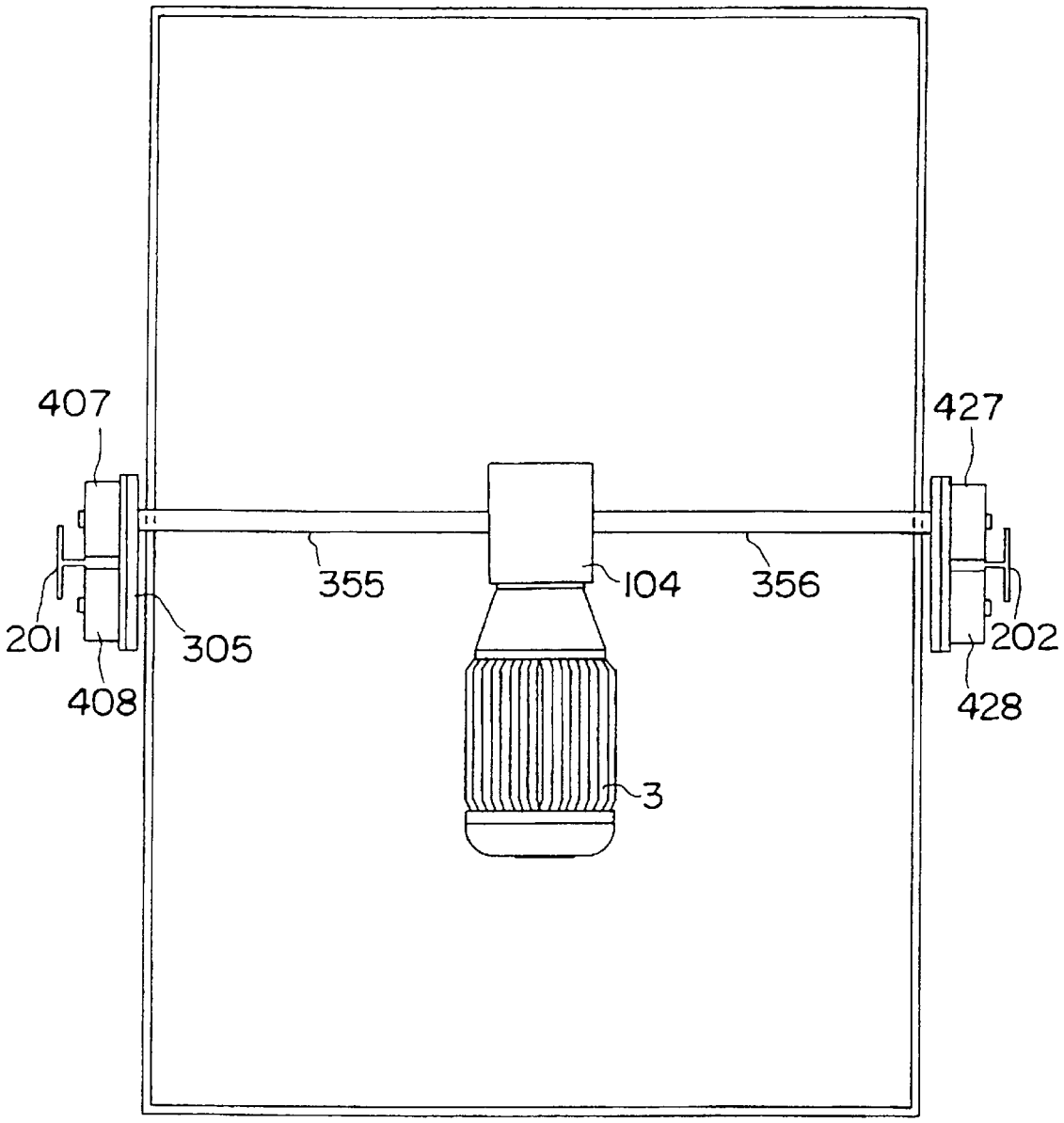
FIG. 13 is a top view of the vertical lift shown in FIGS. 11 and 12.

FIGS. 11 to 13 show a vertical lift with two guide rails 201 and 202 that are mounted on opposite sides of the elevator shaft, adjacent the elevator car. The guide rails are designed as T-profiles in this embodiment. Drive rollers 407 and 408 run on opposite sides of one of the T-profiles, and drive rollers 427 and 428 run on opposite sides of the other T-shaped guide rail 202. The rollers are mounted on the corresponding swivel plates. When swivelled, the drive roller 407 and the roller 408 are pressed from opposite sides against the center shank of the T profile 201. Swiveling occurs by means of a lever 340 with variable length that engages lever arm 331 and supports itself with its other end linked to the frame of the elevator car.

The elevator car 54 is driven by means of a motor 3 and a transmission 104, which has two output shafts 355 and 356 extending in opposite directions. The drive roller 407 is mounted at the end of the output shaft 355, and the drive roller 427 is coupled to the end of the output shaft 356. The drive roller pairs 407, 408 and 427, 428, respectively, are also linked to each other by meshing gears as shown.

Figure 14:
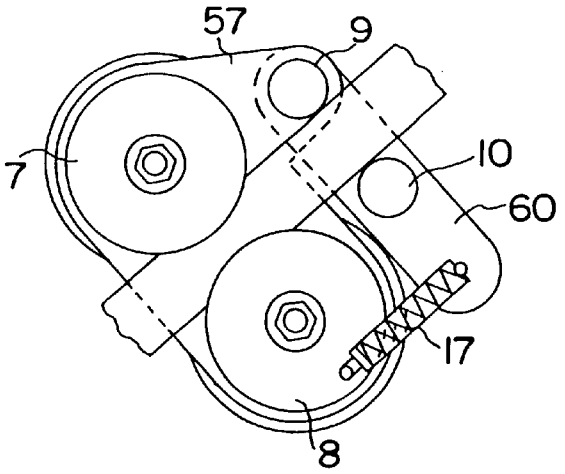
FIGS. 14–16 are side views of three additional embodiments of drive assemblies.
Figure 15:
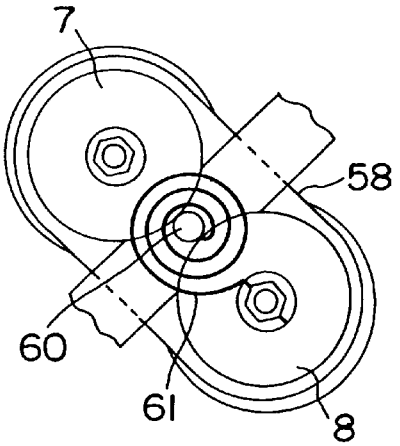
Figure 16:
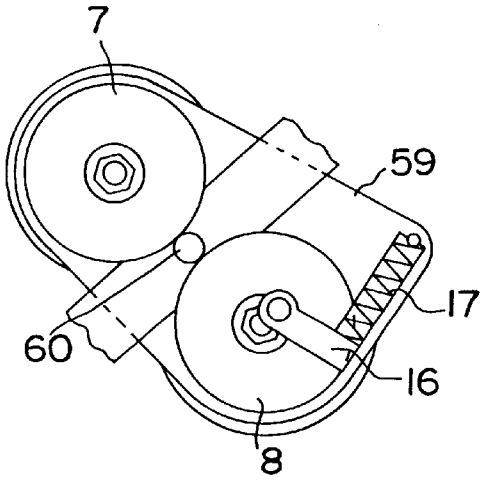

FIGS. 14 to 16 show three additional embodiments of swivel plates with drive rollers that are held under tension in a different manner via springs.

In FIG. 14, the drive roller 7, the gear 8, and a guide roller 9 are mounted on a swivel plate. A flange 60 is mounted on the same axle as the guide roller, so that it can swivel. A guide roller 10 is mounted on flange 60 opposite the guide roller 9. A pressure spring 17 engages flange 60, and is linked at its other end to the swivel plate 57.

In the embodiment according to FIG. 15, the swivel plate 58 is mounted so that it can swivel about a swivel axle 60. The swivel axle runs through the center of the guide rail. A spiral spring is fastened at its center to the swivel axle 60, with its outer end is secured, either directly or indirectly, to the swivel plate 58 at a distance from the swivel axle.

In the embodiment according to FIG. 16, a swivel plate 59 is provided that can also be swivelled around swivel axle 60, the center of which extends through the center of the guide rail. The roller 8 of the roller pair 7, 8 is mounted on an eccentric bolt, which a lever 16 engages. A pressure spring 17 is mounted between the free end of the lever 16 and the swivel plate 59.

The drive mechanisms according to FIGS. 14 to 16 can be used in place of the drive assemblies described in connection with FIGS. 1 to 13.

The pressure of the running rollers, when they are designed of metal, thus with a metal on metal material contact, leads to the fact that the tubular guide rails in the area of the drive roller will be pressed inwardly under the influence of the contact pressure. In practical versions, indented areas or "dents" are formed locally where the rollers contact the rails, in which areas the bearing tube exhibits a diameter that is about 1 mm smaller than the diameter of the unstressed tube. As the lift travels along the rails, the dent travels with it. The driving path tube is thus fulled during the driving process. The migrating dent is compensated again by the inherent elasticity of the driving tube after removal of the contact stress by the drive rollers so that, when not under load, the driving tube maintains the original cylindrical form with the original diameter.

I claim:

1. A lift for a handicapped person comprising:

first and second vertically spaced apart tubular guide rails arranged to run parallel to one another at constant gauge and, along at least along a substantial part of their length, being inclined relative to the ground;

first and second roller supports;

a first pair of guide rollers mounted on said first roller support, on opposite sides of said first guide rail, wherein at least one guide roller of said first pair is a first drive roller;

a second pair of guide rollers mounted on said second roller support, on opposite sides of said second guide rail, wherein at least one guide roller of said second pair is a second drive roller;

means for driving said first drive roller;

means for driving said second drive roller;

at least one spring for pressing said first and second drive rollers against said first and second guide rails for creating a continuous contact force between all said guide rollers and said guide rails; and wherein the drive forces of said drive rollers are transferred to said first and second guide rails, respectively, substantially entirely through frictional engagement between said drive roller and its respective guide rail due to said contact force.

2. A lift according to claim 1, wherein said at least one spring comprises a guided compressed spring.

3. A lift according to claim 2, wherein said roller supports are mounted on a chassis so as to swivel about horizontal axes, and wherein said spring is disposed between said first and second roller supports, and comprising means connecting said spring to said roller supports at a distance from their swivel axes.

4. A lift according to claim 1, wherein the means for driving said second drive roller comprises means connecting said second drive roller to said first drive roller so as to rotate therewith.

5. A lift according to claim 1, wherein the guide rollers of said first pair of guide rollers are coupled to one another, and wherein the guide rollers of said second pair of guide rollers are coupled to one another, such that both guide wheels of both said first and second pair are drive rollers.

6. A lift according to claim 4, wherein the guide rollers of said first pair of guide rollers are coupled to one another, and wherein the guide rollers of said second pair of guide rollers are coupled to one another, such that both guide wheels of both said first and second pair are drive rollers.

7. A lift according to claim 1, comprising an additional pair of guide rollers associated with each roller support, wherein the rollers of each said additional pair are disposed on opposite sides of their respective guide rail.

8. A lift according to claim 1, wherein said roller supports are mounted on a chassis so as to swivel about horizontal axes, and wherein each horizontal swivel axis is centered relative to its respective guide rail.

9. A lift according to claim 3, wherein said roller supports are mounted on a chassis so as to swivel about horizontal axes, and wherein each horizontal swivel axis is centered relative to its respective guide rail.

10. A lift according to claim 1, wherein said roller supports are mounted on a chassis so as to swivel about horizontal axes, wherein said first and second drive rollers have an drive axis, and wherein said horizontal swivel axes are coincident with the drive axis of the respective drive roller.

11. A lift according to claim 3, wherein said roller supports are mounted on a chassis so as to swivel about horizontal axes, wherein said first and second drive rollers have an drive axis, and wherein said horizontal swivel axes are coincident with the drive axis of the respective drive roller.

12. A lift according to claim 1, wherein each guide roller of each said pair has an axis, wherein one guide roller of each pair is mounted on an eccentric, and wherein rotation of said eccentric changes the distance between the axes of the guide rollers on the respective roller support.

13. A lift according to claim 12, further comprising a lever arm coupled to each said eccentric and wherein the said at least one spring comprises a spring engaging each said lever arm for urging said lever arm to rotate to press the rollers of each said pair towards one another with a desired amount of contact pressure.

14. A lift according to claim 1, comprising a pair of additional guide rollers associated with each roller support, wherein said additional guide rollers are disposed on opposite sides of their respective guide rail, wherein each roller support has a base member on which said drive roller and one of said additional guide rollers is mounted, and a second member pivotally connected to said base member on which the other guide roller and other additional guide roller are mounted, and wherein said spring is a compressed spring disposed between said base member and second member for urging said first and second pairs of guide rollers towards one another.

* * * * *